US006619265B2

(12) United States Patent
Tsuchihashi

(10) Patent No.: US 6,619,265 B2
(45) Date of Patent: Sep. 16, 2003

(54) FUEL INJECTION CONTROL APPARATUS FOR INTERNAL COMBUSTION ENGINE

(75) Inventor: Masanori Tsuchihashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 148 days.

(21) Appl. No.: 09/961,189

(22) Filed: Sep. 24, 2001

(65) Prior Publication Data

US 2002/0139354 A1 Oct. 3, 2002

(30) Foreign Application Priority Data

Mar. 4, 2001 (JP) ..... 2001-104378

(51) Int. Cl.[7] ..... F02M 51/00
(52) U.S. Cl. ..... 123/476; 123/478; 123/480
(58) Field of Search ..... 123/480, 478, 123/490, 406.3, 491, 406.32, 406.45, 406.47, 406.58, 476

(56) References Cited

U.S. PATENT DOCUMENTS 4,387,429 A * 6/1983 Yamauchi et al. ..... 701/105
4,825,838 A * 5/1989 Osuga et al. ..... 123/681
5,014,669 A * 5/1991 Takasaki et al. ..... 123/406.55
5,016,591 A * 5/1991 Nanyoshi et al. ..... 123/406.2
5,047,943 A * 9/1991 Takahata et al. ..... 701/101
5,605,132 A * 2/1997 Hori et al. ..... 123/406.24
6,006,707 A * 12/1999 Ito ..... 123/90.15

FOREIGN PATENT DOCUMENTS

JP 61-232343 10/1986

* cited by examiner

*Primary Examiner*—John Kwon
(74) *Attorney, Agent, or Firm*—Sughrue Mion, PLLC

(57) ABSTRACT

A fuel injection control apparatus for an internal combustion engine capable of expediting an initial explosion and hence enhancing an engine starting performance. The apparatus includes a crank angle sensor (1) for generating a crank angle signal indicative of angular position of a crank shaft of an internal combustion engine, various types of sensors (2) for detecting operation states of the internal combustion engine, fuel injectors (3) provided on a cylinder-by-cylinder basis for injecting demanded quantities of fuel (Fs) for individual cylinders, respectively, a cylinder identifying element (4) for identifying discriminatively the individual cylinders on the basis of the crank angle signal to thereby generate a cylinder identification signal, a fuel injection control element (5) for controlling actuation of the fuel injectors (3) of the individual cylinders, respectively, on the basis of the crank angle signal, an engine operation state signal derived from the outputs of the sensors (2) and the cylinder identification signal, and a fuel injection quantity correcting element (6) for correcting time durations for which the fuel injectors (3) are driven upon every fuel injection on the basis of the crank angle signal, the engine operation state signal and the cylinder identification signal.

4 Claims, 3 Drawing Sheets

FUEL INJECTION CONTROL APPARATUS FOR INTERNAL COMBUSTION ENGINE

BACKGROUND OF THE INVENTION

1. Field of the Invention

The present invention relates to a fuel injection control apparatus for an internal combustion engine. More particularly, the invention is concerned with a fuel injection control apparatus for the internal combustion engine in which fuel injectors are provided in association with individual engine cylinders, respectively, wherein the fuel injection control apparatus is designed for effectuating simultaneous injection of fuel for all the cylinders upon engine starting operation.

2. Description of Related Art

In the art, there has already been proposed for the internal combustion engine (hereinafter also referred to simply as the engine) in which the fuel injectors are provided on the cylinder-by-cylinder basis, such a fuel injection control apparatus which is designed for effectuating the step of simultaneous injection of fuel for all the cylinders of the engine upon starting operation thereof. In general, such fuel injection control apparatus is designed to carry out a cylinder identification process or routine and a simultaneous fuel injection process in the engine starting operation mode.

Of the two processes mentioned above, the cylinder identification process or routine is destined for identifying the cylinders for ignition on the basis of a crank angle signal outputted from a crank angle sensor while cranking the engine by means of an engine starter.

On the other hand, the engine starting simultaneous fuel injection process is carried out in succession to the above-mentioned cylinder identification process, whereby the fuel is simultaneously injected for all the cylinders while allowing the ignition to take place in the cylinders identified through the cylinder identification process to thereby crank the engine under the explosion energy. This simultaneous fuel injection process is carried out until the explosion within the cylinders has become stabilized, i.e., until the complete or perfect explosion takes place.

More specifically, in the engine starting simultaneous fuel injection process, the fuel is simultaneously injected for all the cylinders of the engine. In that case, the fuel quantity which corresponds to a quotient resulting from the division of the fuel quantity required or demanded for the combustion by the number N of the cylinders is injected under the timing of the crank angle signal as the basic fuel quantity to be injected at one time.

In this conjunction, it is noted that the conventional fuel injection control apparatus known heretofore is designed to inject the basic quantity of fuel after the cylinder identification process has been completed in the engine starting operation mode.

At this juncture, let's represent the fuel quantity required for the single combustion by Fs, while representing by Fb the basic fuel injection quantity for one simultaneous fuel injection in the engine having N cylinders in the engine starting simultaneous fuel injection process. Then, the following expression applies valid.

$$Fb=Fs/N \quad (1)$$

The conventional fuel injection control apparatus described above suffers a problem that a lot of time is taken for starting the engine operation because N steps are required for injecting the fuel quantity required for the combustion. In other words, the engine starting operation is accompanied with a noticeable time lag, to a disadvantage.

Furthermore, in the state where the cylinder identification has not been completed, the fuel injection is disabled. Consequently, even after the identification of cylinders allowing the ignition has been completed, not a little time is taken until the fuel injected actually contributes to the combustion, involving a delay in the initial explosion to another disadvantage.

SUMMARY OF THE INVENTION

In the light of the state of the art described above, it is an object of the present invention to provide a fuel injection control apparatus for the internal combustion engine which is capable of expediting the initial explosion and hence enhancing the engine starting performance.

In view of the above and other objects which will become apparent as the description proceeds, there is provided according to a general aspect of the present invention a fuel injection control apparatus for an internal combustion engine, which apparatus includes a crank angle sensor for generating a crank angle signal indicative of angular position of a crank shaft of an internal combustion engine, various types of sensors for detecting operation states of the internal combustion engine, fuel injectors provided on a cylinder-by-cylinder basis for injecting demanded quantities of fuel for individual cylinders, respectively, a cylinder identifying means for identifying discriminatively the individual cylinders on the basis of the crank angle signal to thereby generate a cylinder identification signal, a fuel injection control means for controlling actuation of the fuel injectors of the individual cylinders, respectively, on the basis of the crank angle signal, an engine operation state signal derived from the outputs of the sensors and the cylinder identification signal, and a fuel injection quantity correcting means for correcting time durations for which the fuel injectors are driven upon every fuel injection on the basis of the crank angle signal, the engine operation state signal and the cylinder identification signal.

By virtue of the arrangement of the fuel injection control apparatus described above, the engine starting operation can be carried out with enhanced stability.

In a mode for carrying out the invention, the fuel injection control means should preferably be so designed as to effectuate the simultaneous fuel injection by driving the fuel injectors before the cylinder identification has been completed.

Owing to the arrangement mentioned above, the initial explosion can be expedited and hence the engine starting performance can significantly be improved.

In another mode for carrying out the invention, the fuel injection control means should preferably be so designed as to effectuate the simultaneous fuel injection by driving the fuel injectors one step before completion of the cylinder identification process.

With the arrangement mentioned above, the initial explosion can be expedited and hence the engine starting performance can significantly be improved.

In a further mode for carrying out the invention, the fuel injection control means should preferably be so designed as to effectuate the simultaneous fuel injection by driving the fuel injectors before the cylinder identification has been completed unless current operation is engine restarting operation while inhibiting the simultaneous fuel injection before the cylinder identification has been completed in the engine restarting mode. In this conjunction, the phrase "engine restarting operation" means the engine starting operation which is carried out in succession to a preceding engine starting operation which failed to bring about the complete explosion.

With the arrangement described above, such situation can positively be evaded that the quantity of fuel within the combustion system becomes excessive due to admixture of the fuel charged initially through the first simultaneous injection and the fuel injected for the engine restarting operation.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
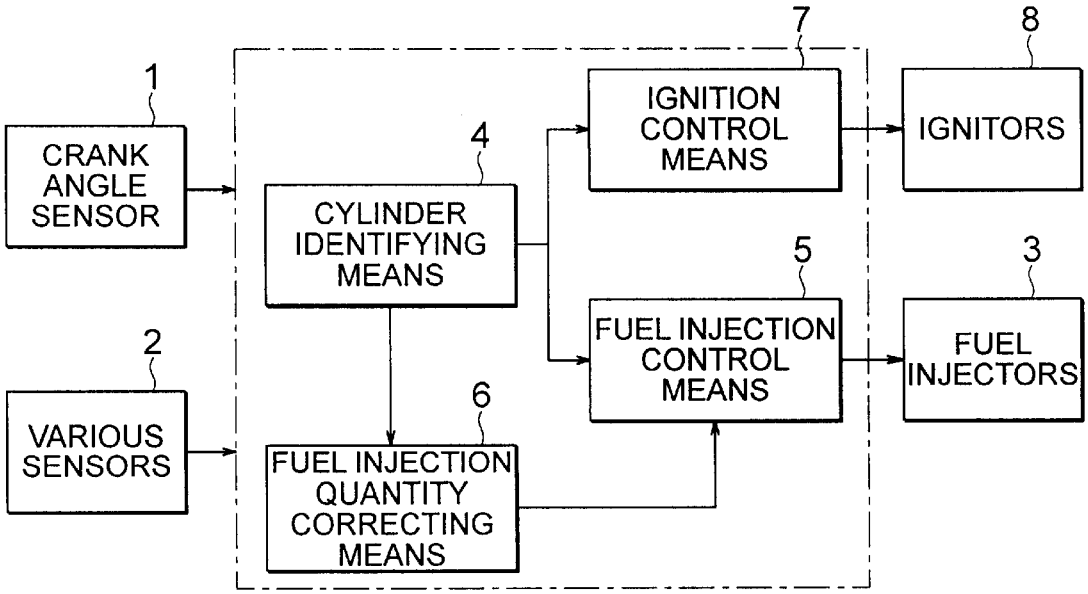
FIG. 1 is a block diagram showing generally and schematically an arrangement of a fuel injection control apparatus for an internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing generally and schematically an arrangement of a fuel injection control apparatus for an internal combustion engine according to a first embodiment of the present invention. Referring to FIG. 1, the fuel injection control apparatus according to the instant embodiment of the invention is comprised of a crank angle sensor 1 for generating a crank angle signal indicative of a rotational or angular position of a crank shaft of the internal combustion engine (hereinafter also referred to simply as the engine), various types of sensors 2 for detecting operation states of the engine, fuel injectors 3 provided on a cylinder-by-cylinder basis for injecting a required or demanded amount of fuel for individual cylinders, respectively, of the engine, a cylinder identifying means 4 for identifying discriminatively the individual cylinders from one another on the basis of the above-mentioned crank angle signal to thereby generate a cylinder identification signal, a fuel injection control means 5 for controlling actuation of the fuel injectors 3 of the individual cylinders, respectively, on the basis of the crank angle signal outputted from the crank angle sensor 1, the engine operation state signal derived from the outputs of the sensors 2 and the cylinder identification signal outputted from the cylinder identifying means 4, a fuel injection quantity correcting means 6 for correcting the fuel quantity to be injected by correspondingly modifying the time duration of the fuel injector 3 being driven or actuated upon every fuel injection on the basis of the crank angle signal, the engine operation state signal and the cylinder identification signal mentioned above, ignitors 8 provided for the individual cylinders of the engine for igniting the air-fuel mixture charged in the associated cylinders, respectively, and an ignition control means 7 for controlling the ignition timings or time points at which the firing sparks are generated by the ignitors 8, respectively.

Figure 2:
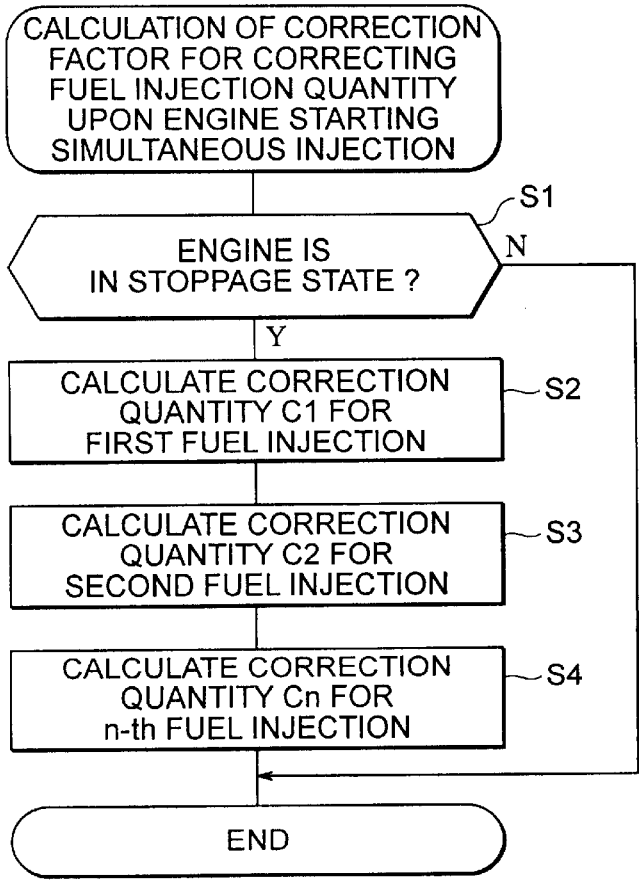
FIG. 2 is a flow chart for illustrating a procedure of determining arithmetically a correction factor for n-th engine starting simultaneous fuel injection in an engine starting simultaneous fuel injection process.

FIG. 2 is a flow chart for illustrating a procedure of determining arithmetically a correction factor for correcting the amount or quantity of the fuel to be injected upon n-th simultaneous fuel injection in the engine starting simultaneous fuel injection process or mode, where n represents a natural number. Referring to FIG. 2, the arithmetic operation for determining the correction factor for correcting the fuel injection quantity in the engine starting simultaneous fuel injection mode is validated only after the stationary or stoppage state of the engine has been confirmed (step S1) and performed upon every fuel injection for determining the correction factor Cn (where n=1, 2, . . . ) for correcting the fuel quantity to be injected (steps S2 to S4).

Figure 3:
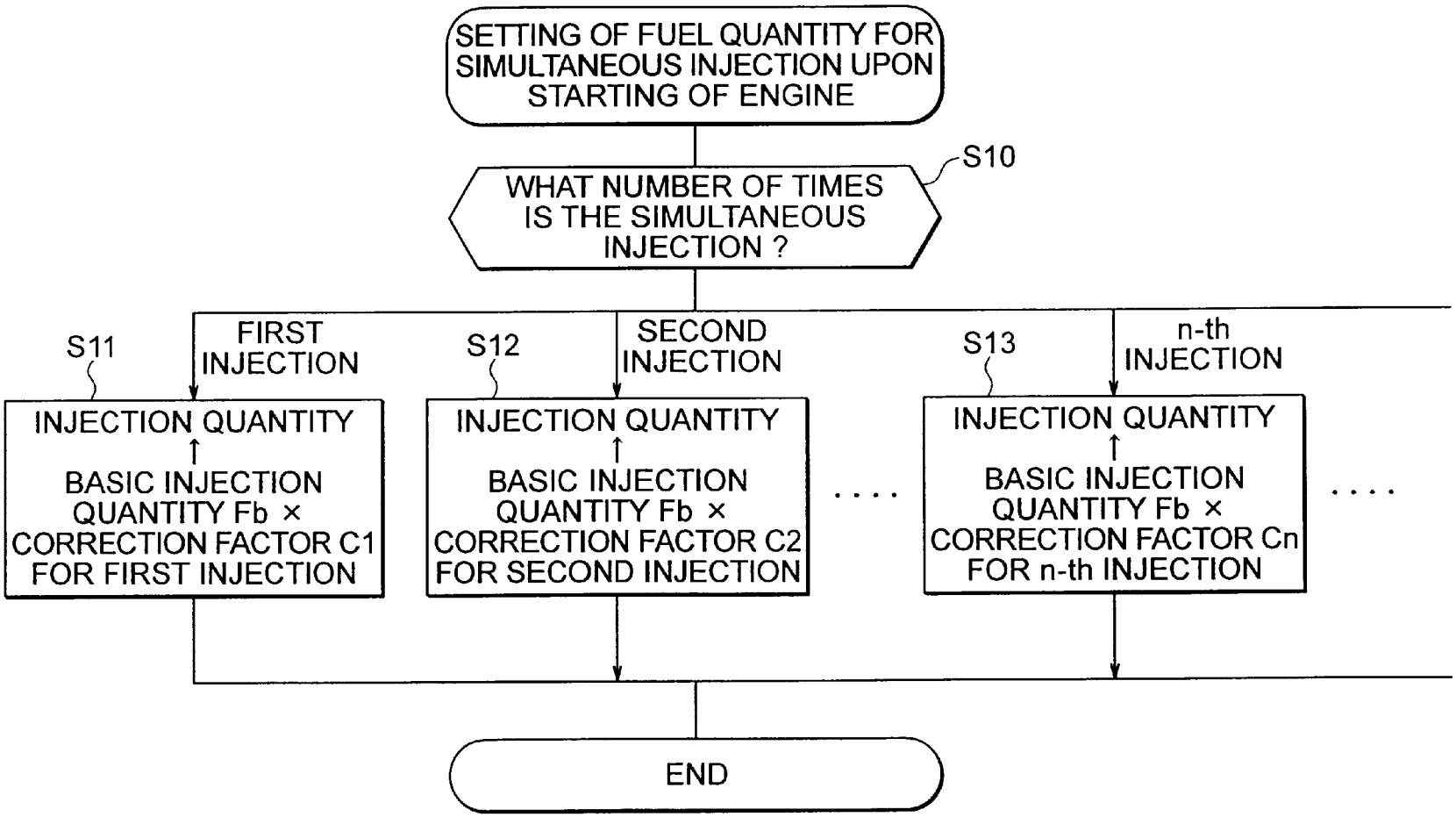
FIG. 3 is a flow chart for illustrating a procedure for arithmetically determining fuel amounts or quantities to be injected a number of times in the simultaneous fuel injection mode for starting the engine operation.

FIG. 3 is a flow chart for illustrating a procedure for arithmetically determining the fuel amounts or quantities to be injected a number (n) of times in the simultaneous fuel injection mode for starting the engine operation. At this juncture, let's represent the number of the cylinders of the internal combustion engine under consideration by N, the fuel amount or quantity demanded for combustion in the engine by Fs and the engine starting basic simultaneous fuel injection quantity for each cylinder by Fb. Then, the following expression applies valid:

$$Fb=Fs/N \tag{1}$$

Further, the correction factor for correcting the fuel quantity to be injected for the n-th simultaneous fuel injection determined arithmetically through the procedure illustrated in FIG. 2 is represented by Cn (where n=1, 2, . . . ). Then, according to the teachings of the invention incarnated in the instant embodiment, the first engine starting simultaneous fuel injection quantity is determined by multiplying the basic simultaneous fuel injection quantity Fb by the correction factor C1 determined in the step S2 shown in FIG. 2, as can be seen in FIG. 3. In more general terms, the fuel injection quantity for the n-th simultaneous fuel injection in the engine operation starting mode is determined by multiplying the basic simultaneous fuel injection quantity Fb by the correction factor Cn (where n=1, 2, 3 . . . ). Thus, by selectively setting the correction factor C1 for the first fuel injection so that the fuel quantity Fs required for the combustion can be injected through the first simultaneous fuel injection, the fuel quantity demanded for the combustion can be charged through the first fuel injection, whereby the initial explosion can be expedited.

Subsequently, for the second fuel injection, the correction factor C2 for correcting the fuel quantity to be injected through the second simultaneous injection is so selected that the sum of the amount of the fuel to be injected at this time and that of the fuel which remains uncombusted in the combustion system after the combustion of the fuel injected firstly and which can thus contribute to the succeeding combustion becomes substantially equal to the demanded fuel quantity Fs required for the combustion. Similarly, for the third fuel injection, the correction factor C3 for correcting the fuel quantity to be injected through the third simultaneous fuel injection is so selected that the sum of the amount of the fuel to be injected at this time and that of the fuel which remains uncombusted in the combustion system after the combustion of the fuel injected at the second time and which can thus contribute to the combustion becomes substantially equal to the demanded fuel quantity Fs required for the succeeding combustion. In more general terms, for the n-th simultaneous fuel injection, the correction factor Cn for correcting the fuel quantity therefor is so selected that the sum of the amount of the fuel to be injected at this time and that of the fuel which remains uncombusted in the combustion system after the first to the (n−1)th combustions and which can thus contribute to the n-th combustion becomes substantially equal to the demanded fuel quantity Fs required for the n-th combustion. By setting the correction factors Cn (where n=1, 2, . . . ) as described above, not only the initial explosion can be expedited but also the succeeding explosions can be caused to occur with enhanced stability. At this juncture, it should be added that the correction factor Cn (where n=1, . . . ) may be determined as a function of the temperature or the like factor as well. Alternatively, the correction factor Cn may set as a constant.

Two sets of exemplary numerical values of the correction factor Cn determined experimentarily are mentioned below in conjunction with the case where the internal combustion engine concerned is of four-cylinder type.

NUMERICAL EXAMPLE (1)

In the ordinary engine starting operation,
the correction factor C1=4.5 for the 1st fuel injection,
the correction factor C2=0.8 for the 2nd fuel injection,
the correction factor C3=0.9 for the 3rd fuel injection, and
the correction factor C4=1 for the 4th fuel injection.

In the case of the ordinary starting operation for the four-cylinder internal combustion engine, the correction factor C1 for correcting fuel quantity for the first injection will normally be "4". However, taking into consideration the fact that some part of the fuel injected at the first time will remain uncombusted in the path along which the fuel injected from the fuel injector 3 flows through the intake pipe into the engine cylinder (i.e., the combustion system), the correction factor Cl should be set greater than "4". It has experimentarily been established that the correction factor C1 for the first fuel injection should preferably be set to "4.5", as mentioned above, although it depends on the various factors such as the temperature and others.

On the other hand, the second correction factor C2 and the third correction factor C3 are set to be smaller than "1" in view of the fact that some part of the fuel injected firstly and remaining uncombusted is also charged into the engine. However, for the fourth injection et seq., influence of the fuel remaining uncombusted in the first injection may be ignored. Accordingly, the correction factor Cn (where n=4, 5, . . . ) for the fourth fuel injection et seq. is set to be equal to "1".

NUMERICAL EXAMPLE (2)

In the engine starting operation at an extremely low temperature,
the correction factor C1=1.6 for the 1st fuel injection,
the correction factor C2=1.4 for the 2nd fuel injection,
the correction factor C3=1.2 for the 3rd fuel injection, and
the correction factor C4=1 for the 4th fuel injection.

When the engine operation is started in the state where the temperature is extremely low, the fuel injected is less susceptible to atomization or evaporation. Accordingly, the values of the correction factor Cn in the numerical example (2) differ from those of the numerical example (1) mentioned previously.

Figure 4:
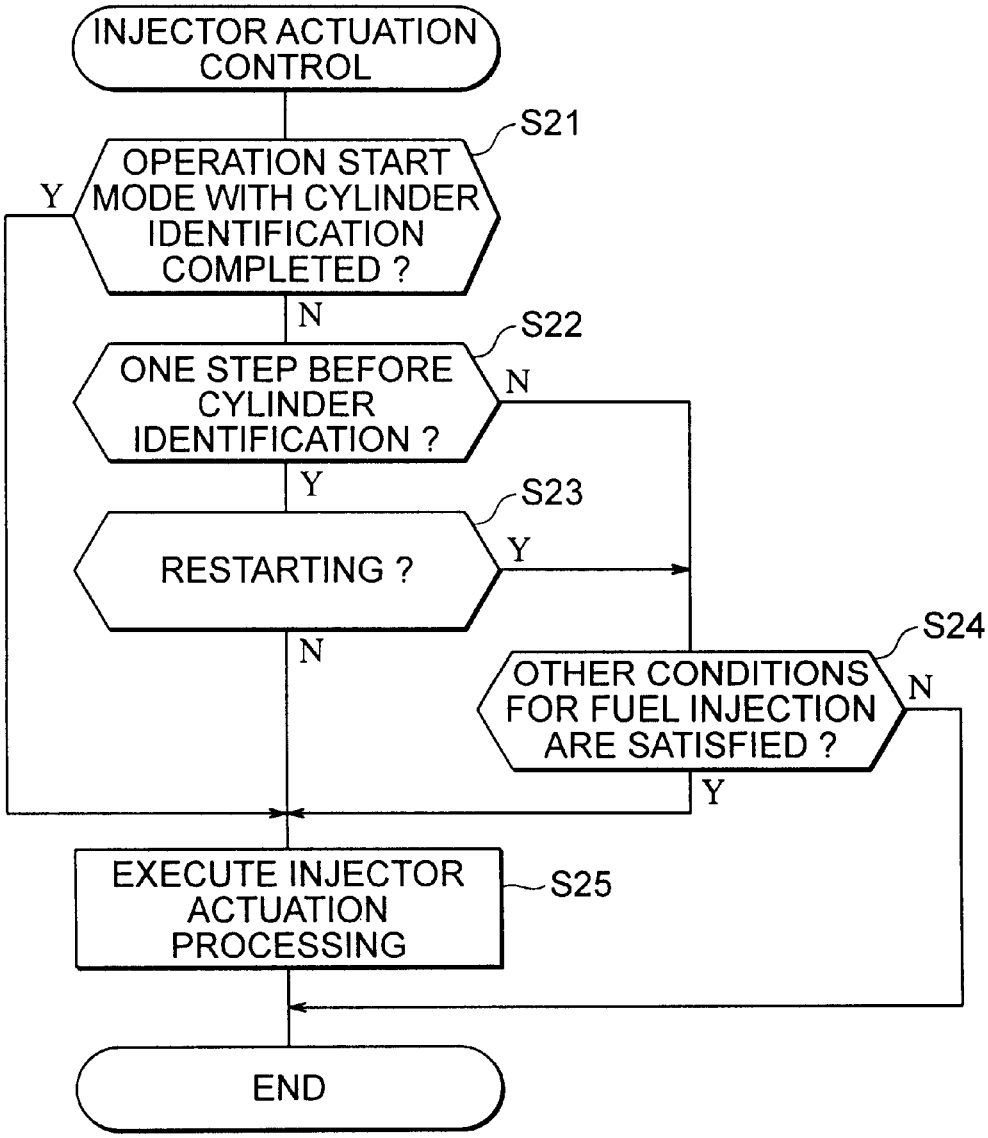
FIG. 4 is a flow chart for illustrating a procedure for controlling actuation of fuel injectors on the basis of the fuel injection quantities set through the procedure shown in FIG. 3.

FIG. 4 is a flow chart for illustrating a procedure for controlling actuation of the fuel injectors on the basis of the fuel injection quantities determined or set as described above by reference to the flow chart shown in FIG. 3. According to the teachings of the present invention incarnated in the instant embodiment, there may occur such case where the fuel injectors 3 are actuated or driven for effectuating the simultaneous fuel injection even when the cylinder identification process has not been completed. By virtue of this feature, explosion can be triggered by the first ignition without fail in succession to the completion of the cylinder identification process, whereby the initial explosion can be expedited.

More specifically, referring to FIG. 4, when it is decided in a step S21 that the cylinder identification has not been completed yet in the engine operation starting mode (i.e., when the decision step S21 results in negation "N"), then it is checked in a step S22 whether or not the current time point is one step before the completion of cylinder identification routine. When it is decided in the step S22 that the current time point is one step before the completion of the cylinder identification routine (i.e., when the step S22 results in affirmation "Y"), decision is then made in a step S23 as to whether or not the engine restarting operation is being tried. Unless the restarting operation mode is validated (i.e., when the step S23 results in "N"), the fuel injectors are driven for effectuating the simultaneous fuel injection in a step S25. More specifically, even in the case where the cylinder identification has not been completed, the fuel injectors are actuated to effectuate the simultaneous fuel injection so long as the current operation is not for restarting the engine notwithstanding that the current time point is one step before the completion of cylinder identification which enables the ignition.

On the other hand, when it is decided that the current time point is not one step before the completion of cylinder identification routine or the operation now of concern is for restarting the engine, then it is checked in a step S24 whether or not other conditions for the fuel injection are satisfied. When the conditions for fuel injection are satisfied (i.e., when the decision step S24 results in "Y"), the fuel injectors are driven for effectuating the simultaneous fuel injection in the step S25. In other words, in the case of the restarting operation, the simultaneous fuel injection is not validated at the time point corresponding to one step before the completion of the cylinder identification. In this manner, in the restarting operation, such situation can be avoided in which the fuel quantity becomes excessive within the combustion system due to admixture of the fuel charged through the simultaneous injection in the preceding starting operation with the fuel injected at the current time point. At this juncture, it should be mentioned that with the phrase "the engine restarting operation" or "operation for restarting the engine", it is contemplated to mean the starting operation performed immediately after the preceding engine starting operation which has not involved the complete explosion.

Many modifications and variations of the present invention are possible in the light of the above techniques. It is therefore to be understood that within the scope of the appended claims, the invention may be practiced otherwise than as specifically described.

What is claimed is:

1. A fuel injection control apparatus for an internal combustion engine, comprising:

a crank angle sensor for generating a crank angle signal indicative of angular position of a crank shaft of an internal combustion engine;

various types of sensors for detecting operation states of said internal combustion engine;

fuel injectors provided on a cylinder-by-cylinder basis for injecting demanded quantities of fuel for individual cylinders, respectively;

cylinder identifying means for identifying discriminatively said individual cylinders on the basis of said crank angle signal to thereby generate a cylinder identification signal;

fuel injection control means for controlling actuation of said fuel injectors of said individual cylinders, respectively, on the basis of said crank angle signal, an engine operation state signal derived from the outputs of said sensors and said cylinder identification signal; and fuel injection quantity correcting means for correcting time durations for which said fuel injectors are driven upon every fuel injection on the basis of said crank angle signal, said engine operation state signal and said cylinder identification signal.

2. A fuel injection control apparatus for an internal combustion engine according to claim 1, wherein said fuel injection control means is so designed as to effectuate simultaneous fuel injection by driving said fuel injectors before the cylinder identification has been completed.

3. A fuel injection control apparatus for an internal combustion engine according to claim 2, wherein said fuel injection control means is so designed as to effectuate the simultaneous fuel injection by driving said fuel injectors one step before completion of cylinder identification process.

4. A fuel injection control apparatus for an internal combustion engine according to claim 1, wherein said fuel injection control means is so designed as to effectuate simultaneous fuel injection by driving said fuel injectors before the cylinder identification has been completed unless current operation is engine restarting operation while inhibiting said simultaneous fuel injection before the cylinder identification has been completed, wherein said restarting operation means the engine starting operation which succeeds to a preceding engine starting operation in which complete explosion has not taken place.

* * * * *